United States Patent [19]

Parker et al.

[11] Patent Number: 4,860,815

[45] Date of Patent: Aug. 29, 1989

[54] METHOD FOR FORMING RECYCLABLE POUR TOOL

[75] Inventors: Kent Parker, Dover; Bruce Batchelder, Barrington; Norman Clavette, Dover, all of N.H.

[73] Assignee: Davidson Textron Inc., Dover, N.H.

[21] Appl. No.: 85,796

[22] Filed: Aug. 17, 1987

[51] Int. Cl.[4] ..... B22C 7/00

[52] U.S. Cl. ..... 164/47; 164/45; 264/46.6; 264/225; 264/227

[58] Field of Search ..... 264/227, 46.6, 225; 164/45, 46, 47

[56] References Cited

U.S. PATENT DOCUMENTS

| | | | |
|---|---|---|---|
| 1,792,486 | 2/1931 | Feinberg | 264/227 |
| 2,154,169 | 4/1939 | Koehler | 264/227 |
| 3,285,835 | 11/1966 | Farrow | 264/227 |
| 3,562,049 | 2/1971 | Maher | 264/227 |

FOREIGN PATENT DOCUMENTS

| | | | |
|---|---|---|---|
| 61-293628 | 12/1986 | Japan | 164/45 |

*Primary Examiner*—Jan H. Silbaugh
*Assistant Examiner*—Allan R. Kuhns
*Attorney, Agent, or Firm*—John C. Evans

[57] ABSTRACT

A method and apparatus for manufacturing a composite article by use of a mold core and a cavity block and wherein a skin and insert are placed in the mold cavity and foam precursors are poured into the mold cavity to complete the article includes a process in which a series of part replicas are formed and used to cast thermally stable liners that are carried by the mold core and mold cavity. The thermally stable liners have low melt temperatures and can be reused and recast following wear during the molding process. The liners are made from material which has low shrinkage and expansion rates to define a mold assembly that will produce repeatable parts.

5 Claims, 2 Drawing Sheets

FIG. 1
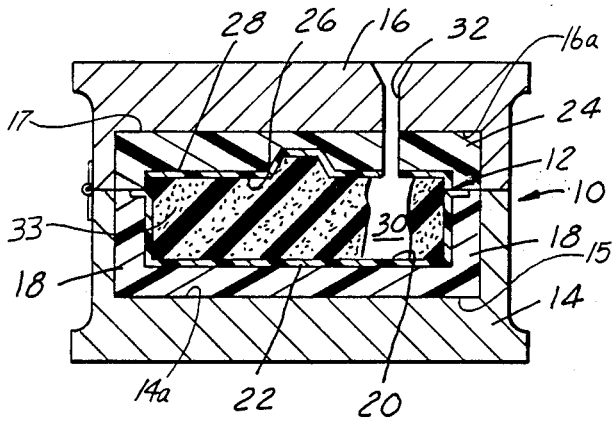
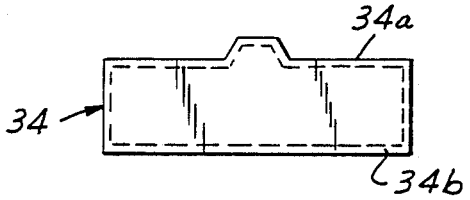
FIG. 2
FIG. 3
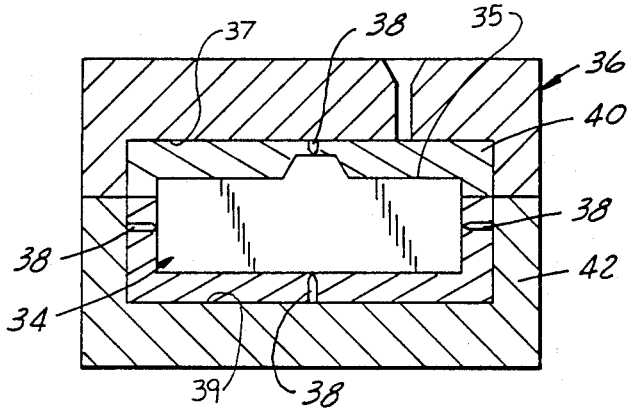
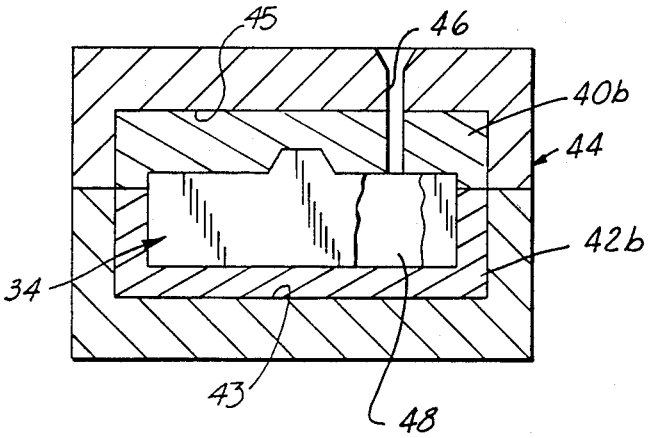
FIG. 4

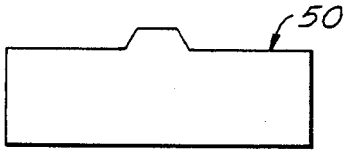
FIG.5
FIG.6
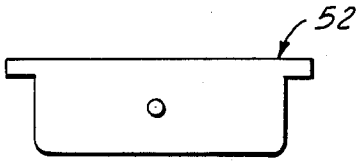
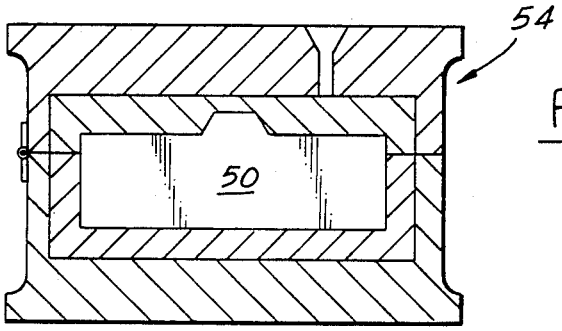
FIG.7
FIG.8
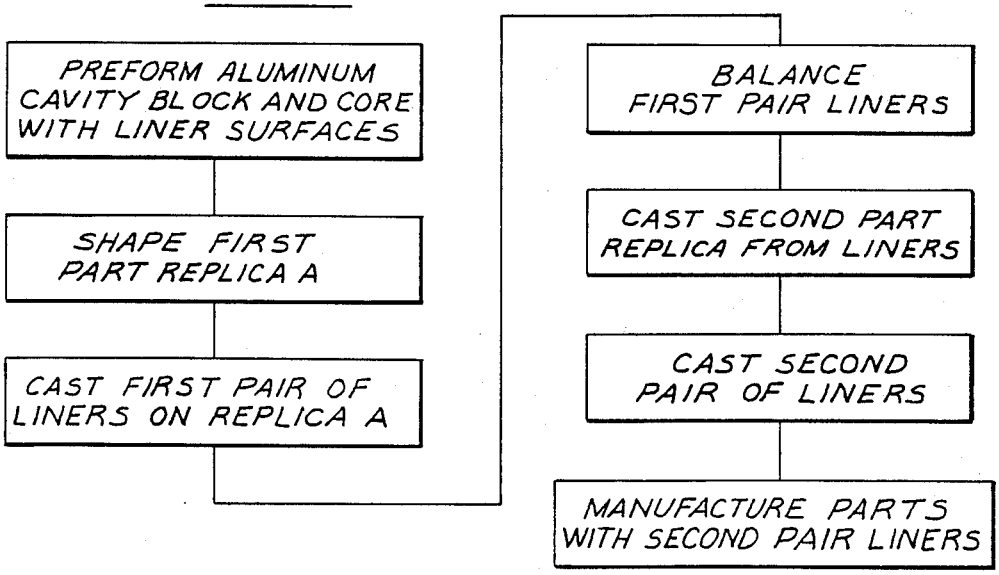

METHOD FOR FORMING RECYCLABLE POUR TOOL

TECHNICAL FIELD

This invention relates to methods and apparatus for forming a composite article from foam material and more particularly to a method in which foam precursors are placed in a mold cavity which is formed by a cavity block and a cavity core and serve to support a skin and a mold insert respectively.

BACKGROUND ART

U.S. Pat. No. 4,420,447 issued Dec. 13, 1983 discloses a mold apparatus having a cavity block and a cavity core which are operated to receive skin, insert and foam components which are combined to define a finished composite article. U.S. Pat. Nos. 1,973,550; 2,336,578; 2,757,426; 3,325,861; 3,380,121; and 3,643,911 disclose various liners for mold tooling. They do not disclose a method for balancing mold tooling by the process of the present invention including use of reuseable, thermally stable alloy material and use of a theoretical and an actual part replica to form balanced liner components.

The current method for making the cavity block and cavity core components of such apparatus includes use of a sand mold formed by a wood or epoxy mandrel shaped to conform to the mold tool configuration. The sand mold cavity is filled with aluminum to form the tool. Aluminum has an inherent shrinkage in the range of 0.013 inches and consequently the mandrels are constructed oversized (with a 0.013 inch expansion factor) to compensate for shrinkage.

Such compensation has its faults since in real practice cast aluminum does not have the same shrinkage over all sections and over all dimensions of the casting due in part to different rates of cooling caused by the part configuration and casting methods. As a result, tools made by this method do not always match with a theoretically perfect skin or insert carried thereon during the manufacture of a composite article comprising a skin, an insert and foam material.

In real practice the skin and insert also will vary in shape and form making the fit problem even more difficult.

To alleviate the problem such cast aluminum tools are "balanced" by a process which accounts for the afore-described discrepancies. Such balancing may involve shimming, epoxy filling, sanding and grinding of the cast aluminum pour tools to change the fit between them and the insert and skin supported thereon.

The balancing process must be repeated for each set of tools and can involve a considerable monetary and time expense where a large number of part numbers are manufactured by use of such mold tools. Even when the mold system is balanced, later variations which may occur in the manufacture of insert and skin components may require that the mold tools be rebalanced to accomodate such later discovered variations.

STATEMENT OF INVENTION AND ADVANTAGES

One feature of the present method is aimed at producing replaceable mold tools that support separately manufactured components and define a mold cavity for foam material that is poured into and reacted in the mold when the tooling is closed.

To accomplish this objective, first and second pairs of mold liners are formed with respect to mandrels which are dimensioned as replicas of the final composite article. The first pair of mold liners are fit into mold core block and mold cavity core components and are balanced to assure a fit between the skin and insert to be respectively supported thereon. The resultant mold cavity is then filled with epoxy material to form a "balanced" master mandrel against which the second pair of mold liners are cast for use in a production process. The master mandrel is reused to form replacement pairs of mold liners.

A feature of the present invention is that the liners are made of a material which can be recast from the worn liners. Furthermore, the material is characterized by a low melting temperature (lower than aluminum) which enables the liners to be easily reclaimed and recast about the master mandrel.

Since the material is cast against a mandrel which has been balanced with respect to the cavity core and the core block the recast mold liners will not have to be rebalanced.

The mold liner material is thermally stable and will hold the shape of the mold liners both during their manufacture and during processing of a composite including a skin and an insert supported on the liners. While the solution of balancing of mold systems does not address the problem of part variations in separately manufactured insert and skin components it nevertheless eliminates one processing variable. Consequently, the overall process is improved.

The apparatus of the present invention improves a mold assembly having a cavity block and a core block which define a cavity for a skin and an insert as well as a space into which foam precursors are poured to be reacted when the mold is closed to bond to both the skin and the insert and wherein the improvement comprises: a first liner of thermally stable material on the core block with means thereon to support an insert and a second liner of thermally stable material on the cavity core with means thereon to support a skin component and wherein the liner material is reuseable and recastable against a master mandrel to avoid the necessity of rebalancing mold tools when the inserts become worn.

Other advantages and a more complete understanding of the invention will be apparent to those skilled in the art from the succeeding detailed description of the invention and the accompanying drawings thereof.

BRIEF DESCRIPTION OF THE DRAWINGS

FIG. 1 is a diagrammatic view of a mold apparatus of the type improved by use of the present invention.

FIG. 2 is an elevational view of a mandrel formed as a replica of a theoretically perfect part;

FIG. 3 is a diagrammatic view of a casting mold with the replica supported on mold inserts and adapted to have a first pair of mold liners cast thereagainst;

FIG. 4 is a sectional view of the mold liners supported in a mold to form a second part replica;

FIG. 5 is an elevational view of a second master mold replica formed by balanced liners from a balanced set of core block and cavity block tools;

FIG. 6 is a melting pot in which worn liners are remelted for reuse;

FIG. 7 is a mold in which the second mold replica is supported by inserts to have the reused material cast thereagainst to form a replacement set of balanced mold liners for use in the mold apparatus of FIG. 1; and FIG. 8 is a flow chart of the method of the present invention.

DETAILED DESCRIPTION OF THE INVENTION

Referring now to FIG. 1, a mold apparatus 10 is illustrated for manufacturing a composite part 12. The mold apparatus includes a cavity core 14 and a core block 16 having liner support surfaces 14*a* and 16*a* respectively. The cavity core 14 supports the outer surface 15 of a mold liner 18 which defines a support surface 20 for a preformed skin or shell member 22 which is loaded into the mold apparatus 10 when the mold is open. The core block 16 supports the outer surface 17 of a mold liners 24 which define a support surface 26 for a preformed load bearing insert 28 of high strength material. The insert 28 is suitably arranged with respect to the mold insert 18 when the mold is closed. The closed mold defines a cavity space 30 into which foam precursors are poured, for example through a pour hole 32 in the core block 16. Alternatively, the foam precursors can be poured into the cavity core 14 when the mold is open after which the mold is closed and the precursors are allowed to react to form a layer of foam material 33 which is bonded to both the skin member 22 and the load bearing insert 28.

In accordance with the invention the mold liners 18 and 24 are formed from a thermally stable material which preferably is reuseable so that worn mold liners can be recast into exact replicas of the original.

As shown in the method sequence of FIG. 8, the mold apparatus 10 is manufactured so as to balance the tool components in a manner that will eliminate the need for rebalancing the cavity core and the core block when different parts are processed and when the inserts are worn.

More particularly the method includes the steps of obtaining a cast aluminum cavity block and a lid unit including a core block , each configured to hold a liner of a type to be discussed. The liners will have a support surface that provides the fit for the tool and the skin/inserts of the composite part. Then a mandrel 34, FIG. 2, is shaped as a replica of the composite part 12. As such it is dimensioned to account for a thickness 34*a* which corresponds to the thickness of the insert of the composite part 12. As shown in FIG. 2, the replica is formed as a single piece with outer dimensions which correspond to the dimensions of the part 12. It is also dimensioned to account for a thickness 34*b* which corresponds to the thickness of the skin portion of the composite part 12. The mandrel 34 is a 1:1 epoxy replication of the "theoretically perfect" final foamed composite part 12 and no shrinkage factor is included to compensate for cast aluminum tool shrinkage. Next as shown in FIG. 3, the mandrel 34 is supported in a metal castings mold 36 by inserts 38. A thermally stable material of low melting temperature is poured into the mold to cast first and second liners 40,42 which as shown in FIG. 3 conform to the outer surface 35 of the single piece pattern 34 and which are conformed to the surface 37, 39 of the metal casting mold 36. The liners 40,42 have surfaces that will support perfect skin and insert components.

In real practice the liners 40,42 do not match all other components of a mold apparatus so, the present process includes the step of balancing the liners 40, 42 by shimming the mold assembly parts and grinding and filling as necessary to assure an accurately defined surface support for the insert and skin components of a composite part 12.

Following balancing of the mold apparatus the balanced liners 40*b*, 42*b* are used as the mold surfaces to define a cavity space into which epoxy material is poured to form a second epoxy mandrel that conforms to the balanced mold assembly. The mold 44 has liner support surfaces 43,45 for supporting the liners 40*b*, 42*b* is shown in FIG. 4. It has a pour hole 46 through which epoxy material is poured to fill the mold space 48. The mold space, when filled represents the second mandrel 50 shown in FIG. 5. The second mandrel 50 is a replica of the actual part which will be formed in the mold apparatus, rather than an intended perfect part which is represented by the first mandrel 34.

The second mandrel 50 is then used to form all subsequent pour tool liners all of which will be utilized in previously balanced mold apparatus without a need for rebalancing the system. The same mandrel 50 can be used to recast tool liners from the material of worn liners.

FIG. 6 is a diagrammatically shown melt pot 52 in which used liners can be reclaimed. FIG. 7 shows a mold 54 in which the mandrel 50 is placed to reform liners exactly matching those which can be used in mold apparatus without the need for rebalancing of the system.

In accordance with certain principles of the present invention the liners are formed from material which is thermally stable so as to maintain an accurate surface for support of insert and skin components during continuous molding processes in which the temperatures of the liners can vary. One suitable material is Tafaloy 4328 manufactured by TAFA Inc.

The material is a bismuth based alloy with a density which is in the order of 3 time that of cast aluminum. Accordingly, only the liner is made of the thermally stable material and the remainder of the tool system can be made of lighter weight material to enhance tool handling. The material cost is offset by reuse of the material. Its melt temperature is approximately 310 degrees F. so that worn liners are readily melted down and recast. Furthermore, recast liners can be placed in the same aluminum cavity block and cavity core units of a mold system. A supply of standardized cavity block and cavity core units configured to receive such improved liners provide flexibility in manufacture of different types of parts.

The use of Tafaloy alloy retains part repeatability because of thermally stable properties as follows:

expansion on cooling—0.0005 in/in (approx 26 times less relative change than aluminum)

casting temperature—300 degrees F. (does not require foundry type equipment to melt and recast)

thermal conductivity—$\frac{1}{8}$ as conductive as cast aluminum—25 times as conductive as aluminum filled epoxy.

Another material candidate for the liner is aluminum filled methyl methacrylate (cast acrylic). The material has good dimensional stability and thermal properties acceptable for foam pour tool applications. The following values are for 60% aluminum filled cast acrylic.

shrinkage after curing—0.001 in/in (13 times less relative change in dimensional properties after casting than aluminum)

thermal conductivity—1/67 as conductive as aluminum and 3 times as conductive as aluminum filled (50%) epoxy The proposed method for making a pour tool with cast acrylic is similar to that described with respect to a bismuth based alloy. The liners 18 and 24 will be formed from the cast acrylic material by use of the two formed mandrel replicas of the final composite part in the sequence shown in FIG. 8. The only difference is that the acrylic material can not be reused and recast into new liners following wear of an original set of actual part liners.

Use of such liners and their method of manufacture is especially advantageous in the production of a wide variety of parts which are manufactured by the foam pour tool procedure.

What is claimed is:

1. A method for manufacturing liners with outer surfaces for mounting on a production mold apparatus to define a mold cavity, the metal liners having inner surfaces which exactly conform to the exterior dimensions of a composite plastic article having a preformed skin adapted to be supported on the inner surface of one of the metal liners and a preformed load bearing insert adapted to be supported on the inner surface of the other of the metal liners and wherein a layer of foam material is located between the performed skin and the preformed load bearing insert to be bonded thereto comprising the steps of:

dimensionally shaping a single piece pattern which has outer dimensions thereon corresponding to those of the composite plastic article including the foamed preformed skin and preformed load bearing insert;

providing metal casting mold means having an interior space greater than the dimensions of the single piece pattern;

supporting the single piece pattern in the interior space of the metal casting mold means to provide a space for filling with metal to form liners conformed to the outer surface of the single piece pattern and conformed to the metal casting mold means;

casting aluminum filled methyl methacrylate into the last mentioned space for filling said space to form liners conformed to the single piece pattern and conformed to the metal casting mold means;

providing a mold assembly having liner support surfaces thereon;

removing the cast aluminum filled methyl methacrylate liners from the metal casting mold means and placing them on the liner support surfaces of the mold assembly;

shimming the aluminum filled methyl methacrylate liners with respect to the liner support surfaces of the mold assembly to form a space within the mold assembly which corresponds to the outer dimensions of a foamed preformed load bearing insert and preformed skin of a composite plastic part;

pouring material into the space to form a second single piece pattern which is conformed to the shape of the interior surfaces of the aluminum filled methyl methacrylate liners; and supporting the second single piece pattern on the metal casting mold to form a space for forming a second set of liners that have outer surfaces thereon which are supportable on a mold assembly to form an interior space when supported on the mold assembly which corresponds to the outer dimension of the foamed preformed load bearing insert and preformed skin and to form the support surfaces on the mold assembly for the performed load bearing insert and the preformed skin.

2. A method for manufacturing recyclable liners with outer surfaces for mounting on a production mold apparatus to define a mold cavity, the metal liners having inner surfaces which exactly conform to the exterior dimensions of a composite plastic article having a preformed skin adapted to be supported on the inner surface of one of the metal liners and a preformed load bearing insert adapted to be supported on the inner surface of the other of the metal liners and wherein a layer of foam material is located between the preformed skin and the preformed load bearing insert to be bonded thereto comprising the steps of:

dimensionally shaping a single piece pattern which has outer dimensions thereon corresponding to those of the composite plastic article including the foamed preformed skin and preformed load bearing insert;

providing metal casting mold means having an interior space greater than the dimensions of the single piece pattern;

supporting the single piece pattern in the interior space of the metal casting mold means to provide a space for filling with metal to form liners conformed to the outer surface of the single piece pattern and conformed to the metal casting mold means;

melting a metallic material at a temperature in the range of 300 degrees F. and pouring the melt into the last mentioned spaced for filling the space to form liners conformed to the single piece pattern and conformed to the metal casting mold means;

providing a mold assembly having liner support surfaces thereon;

removing the metal liners from the metal casting mold means and placing them on the liner support surfaces of the mold assembly;

shimming the metal liners with respect to the liner support surfaces of the mold assembly to form a space within the mold assembly which corresponds to the outer dimensions of a foamed preformed load bearing insert and preformed skin of a composite plastic part;

pouring material into the space to form a second single piece pattern which is conformed to the shape of the interior surfaces of the metal liners; and supporting the second single piece pattern on the metal casting mold to form a space for forming a second set of liners that have outer surfaces thereon which are supportable on a mold assembly to form an interior space when supported on the mold assembly which corresponds to the outer dimension of the foamed preformed load bearing insert and preformed skin and to form the support surfaces on the mold assembly for the preformed load bearing insert and the preformed skin.

3. A method for manufacturing recyclable liners with outer surfaces for mounting on a production mold apparatus to define a mold cavity, the metal liners having inner surfaces which exactly conform to the exterior dimensions of a composite plastic article having a preformed skin adapted to be supported on the inner surface of one of the metal liners and a preformed load bearing insert adapted to be supported on the inner surface of the other of the metal liners and wherein a layer of foam material is located between the preformed skin and the preformed load bearing insert to be bonded thereto comprising the steps of:

dimensionally shaping a single piece pattern which has outer dimensions thereon corresponding to those of the composite plastic article including the foamed preformed skin and preformed load bearing insert;

providing metal casting mold means having an interior space greater than the dimensions of the single piece pattern;

supporting the single piece pattern in the interior space of the metal casting mold means to provide a space for filling with metal to form liners conformed to the outer surface of the single piece pattern and conformed to the metal casting mold means;

melting bismuth based metallic material at a temperature in the range of 300 degrees F. and pouring the melt into the last mentioned spaced for filling the space to form liners conformed to the single piece pattern and conformed to the metal casting mold means;

providing a mold assembly having liner support surfaces thereon;

removing the cast bismuth based metallic liners from the metal casting and mold means and placing them on the liner support surfaces of the mold assembly;

shimming the bismuth based metallic liners with respect to the liner support surfaces of the mold assembly to form a space within the mold assembly which corresponds to the outer dimensions of a foamed preformed load bearing insert and preformed skin of a composite plastic part;

pouring material into the space to form a second single piece pattern which is conformed to the shape of the interior surfaces of the bismuth based metal liners; and supporting the second single piece pattern on the metal casting mold to form a space for forming a second set of liners that have outer surfaces thereon which are supportable on a mold assembly to form an interior space when supported on the mold assembly which corresponds to the outer dimension of the foamed preformed load bearing insert and preformed skin and to form the support surfaces on the mold assembly for the preformed load bearing insert and the preformed skin.

4. In the method of claim 2, casting each of the liners from a bismuth-based alloy material.

5. In the method of claim 3, the bismuth based material having a contraction rate during said cooling of approximately 0.0005 in. per in.

* * * * *